US006810564B2

(12) United States Patent
Chan

(10) Patent No.: US 6,810,564 B2
(45) Date of Patent: Nov. 2, 2004

(54) BUCKLE FOR A BAND OR THE LIKE

(75) Inventor: Siu Ming Raymond Chan, Hong Kong (HK)

(73) Assignee: Chung Nam Watch Co., Ltd. (KR)

( * ) Notice: Subject to any disclaimer, the term of this patent is extended or adjusted under 35 U.S.C. 154(b) by 0 days.

(21) Appl. No.: 10/389,745

(22) Filed: Mar. 18, 2003

(65) Prior Publication Data

US 2004/0168285 A1 Sep. 2, 2004

(30) Foreign Application Priority Data

Feb. 27, 2003 (HK) ..... 03101472

(51) Int. Cl.[7] ..... A44C 5/24
(52) U.S. Cl. ..... 24/71 J; 24/265 WS
(58) Field of Search ..... 24/68 J, 69 J, 24/70 J, 71 J, 71 R, 71 T, 71 ST, 71 SB, 71 TD, 71 CT, 71 SK, 71 SD, 265 WS; 224/176

(56) References Cited

U.S. PATENT DOCUMENTS 3,345,705 A * 10/1967 Gaupp ..... 24/71 J
5,305,617 A * 4/1994 Fontana ..... 63/3
6,308,382 B1 10/2001 Takahashi et al.
6,434,798 B1 * 8/2002 Yamakawa et al. ..... 24/71 J

FOREIGN PATENT DOCUMENTS

| | | | | |
|---|---|---|---|---|
| CH | 670941 A5 | * | 7/1989 | ..... A44C/5/24 |
| EP | 344620 A1 | * | 12/1989 | ..... A44C/5/20 |
| EP | 461675 A2 | * | 12/1991 | ..... A44C/5/24 |
| EP | 0638255 A1 | | 2/1995 | |
| EP | 0913106 B1 | | 5/1999 | |
| GB | 2293620 A | | 4/1996 | |
| JP | 07116009 A | * | 5/1995 | ..... A44C/5/24 |
| JP | 09000320 A | * | 1/1997 | ..... A44C/5/24 |
| WO | WO 200001269 A1 | * | 1/2000 | ..... A44B/11/00 |

* cited by examiner

*Primary Examiner*—James R. Brittain
(74) *Attorney, Agent, or Firm*—Burns, Doane, Swecker & Mathis, L.L.P.

(57) ABSTRACT

A buckle (10) for a band or the like is disclosed as including a first link (12), a second link (20) and a third link (28), in which an end of the first link (12) is engaged with an end of the second link (20) for relative swiveling movement, and the first link (12) includes a lock plate (32) releasably engageable with a recess (29) of the third link (28) for locking the first link (12), the second link (20) and the third link (28) against relative movement. A watch band secured with such a buckle (10) is also disclosed.

11 Claims, 14 Drawing Sheets

BUCKLE FOR A BAND OR THE LIKE

This invention relates to a buckle for a band or the like, and in particular such a buckle suitable for use in a watch band or bracelet.

BACKGROUND OF THE INVENTION

Various buckle mechanisms have been devised for use on watches. Some such mechanisms are complicated, and thus difficult and costly to manufacture. In some other such mechanisms, the buckles may be easily inadvertently operated, and the buckle is thus prone to be accidentally opened. It is thus an object of the present invention to provide a buckle for a band or the like in which the aforesaid shortcomings are mitigated, or at least to provide a useful alternative to the public.

SUMMARY OF THE INVENTION

According to a first aspect of the present invention, there is provided a buckle including a first body member and a second body member, wherein a first end of said first body member is engaged with a first end of said second body member for relative swiveling movement, and wherein said first body member includes a movable lock member releasably engageable with a recess of said second body member for locking said first body member and said second body member against relative movement.

According to a second aspect of the present invention, there is provided a band secured with a buckle, said buckle including a first body member and a second body member, wherein a first end of said first body member is engaged with a first end of said second body member for relative swiveling movement, and wherein said first body member includes a movable lock member adapted to be releasably engaged with a recess of said second body member for locking said first body member and said second body member against relative movement.

BRIEF DESCRIPTION OF THE DRAWINGS

A preferred embodiment of a buckle according to the present invention will now be described, by way of example only, with reference to the accompanying drawings, in which.

DETAILED DESCRIPTION OF THE PREFERRED EMBODIMENT

Figure 1:
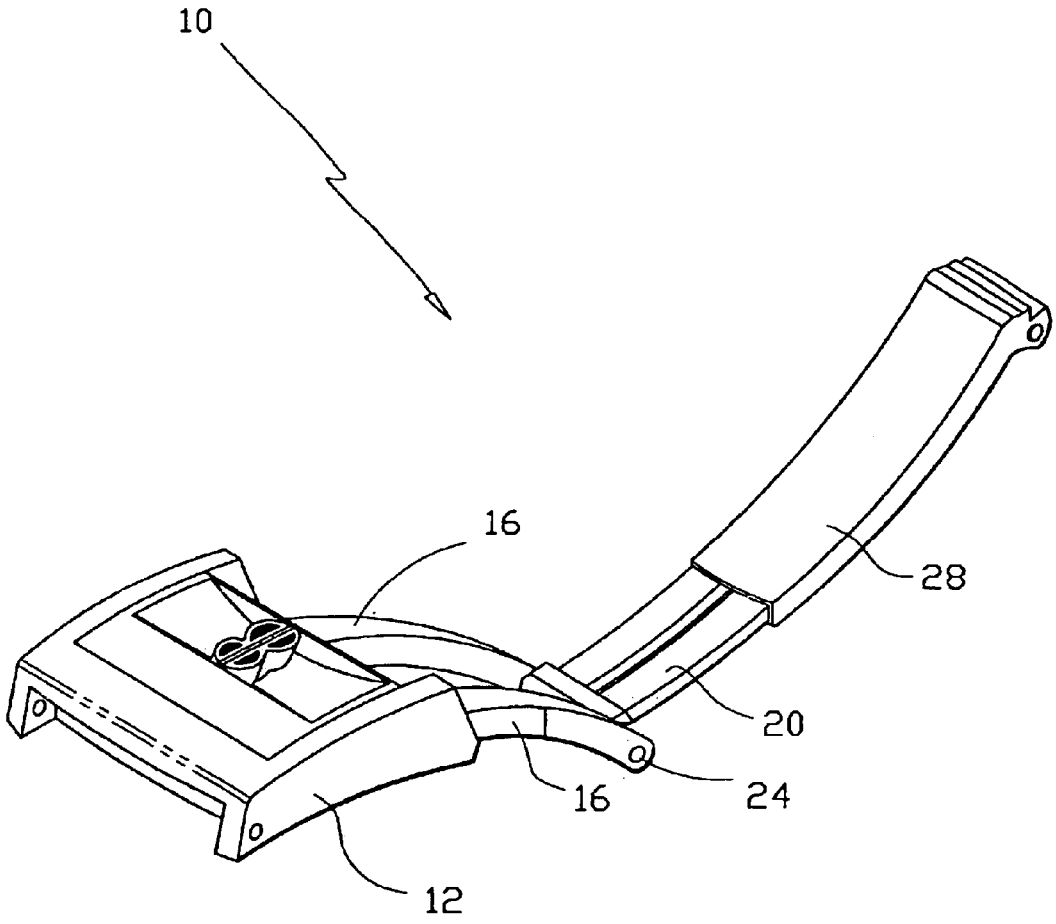
FIG. 1 is a perspective view of a buckle according to the present invention.
Figure 2:
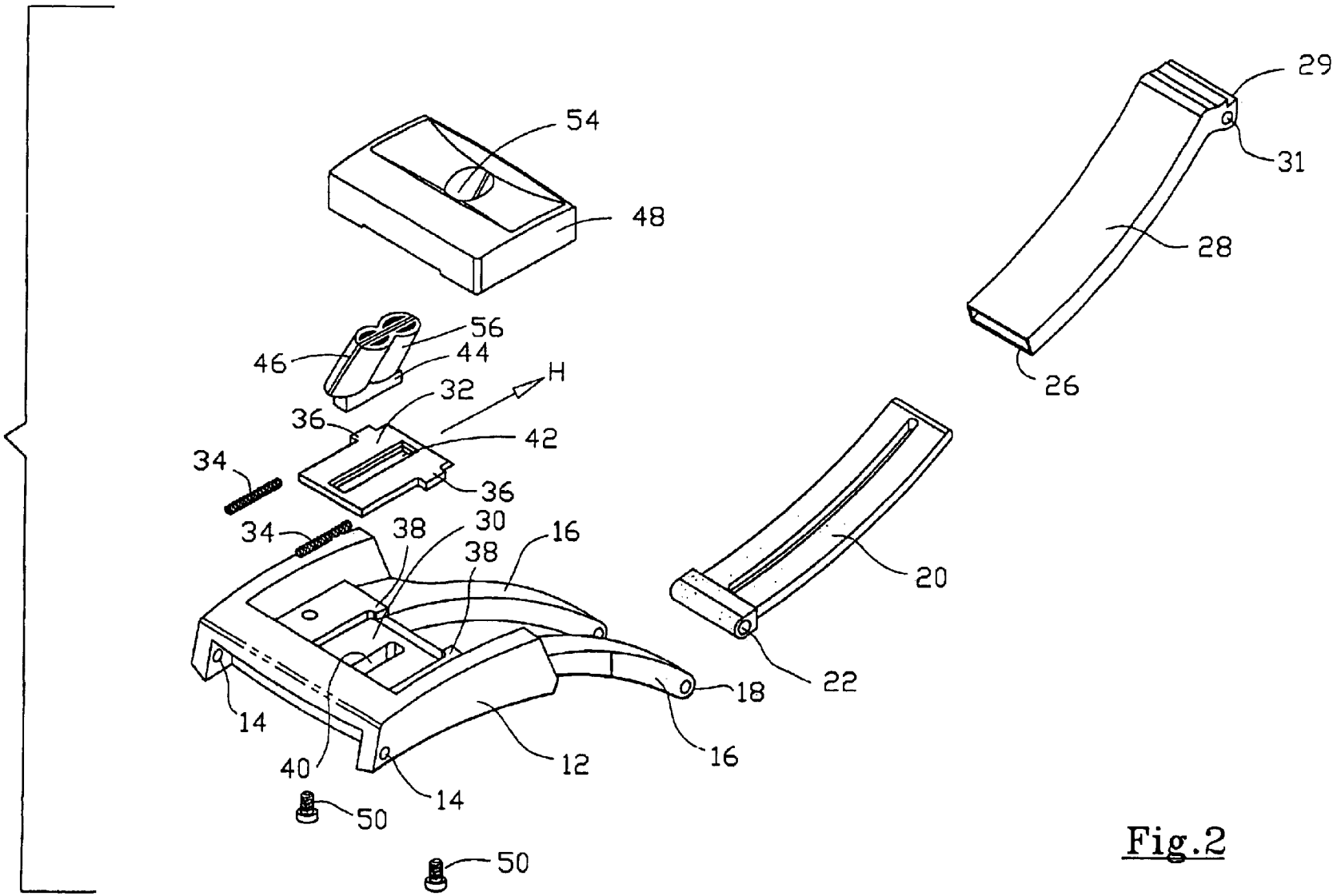
FIG. 2 is an exploded perspective view of the buckle shown in FIG. 1.
Figure 3:
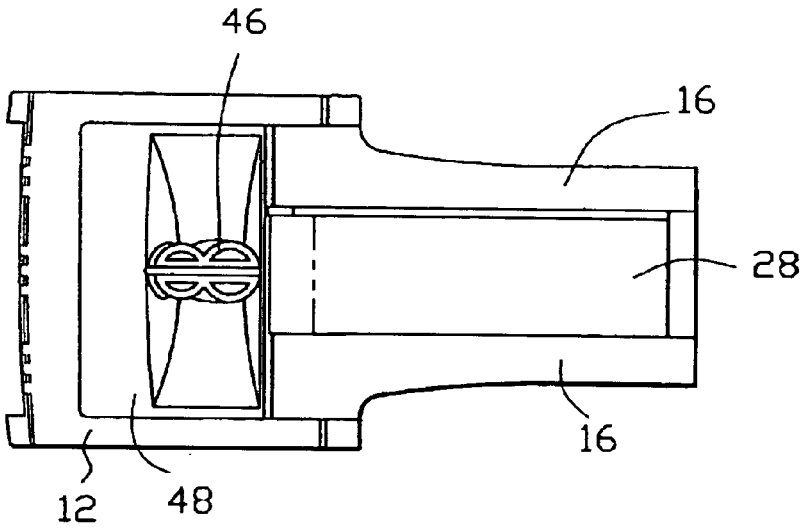
FIG. 3 is a top view of the buckle shown in FIG. 1 in a locked configuration.
Figure 4:
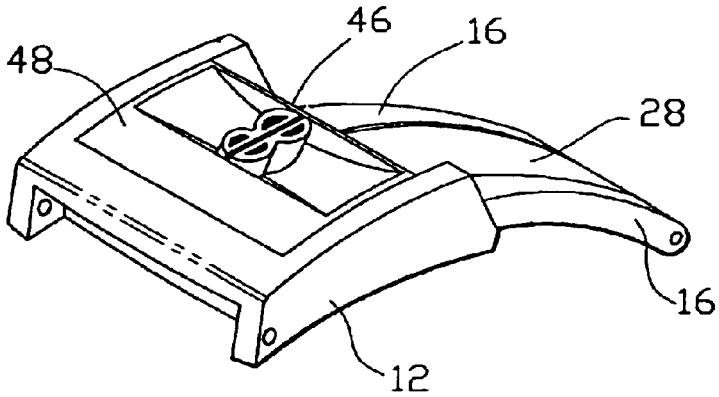
FIG. 4 is a perspective view of the buckle shown in FIG. 3.

A buckle according to a preferred embodiment of the present invention is shown in FIGS. 1 and 2, and generally designated as 10. The buckle 10 includes a first link 12 with two holes 14 at one longitudinal end for engagement with links of a watch band or watch strap (not shown). The first link 12 includes, at another longitudinal end, a pair of legs 16 which are curved along their respective length, each with a transverse through-hole 18 at its respective end, for engagement with a second link 20. The second link 20 also has a transverse through-hole 22 of the same size as the through-holes 18. A pin 24 is received within the through-holes 18, 22 for engaging the first link 12 and the second link 20 for relative swiveling movement about the pin 24. The second link 20 is received within a cavity 26 of a third link 28, enabling the second link 20 and the third link 28 to slide relative to each other. A stopping portion (not shown) is provided within the cavity 26 of the third link 28 for preventing disengagement between the second link 20 and the third link 28. At a longitudinal end of the third link 28 is a transverse recess 29, the function of which will be discussed below. Adjacent to the recess 29 is a transverse through-hole 31 for receiving a pin (not shown) for engaging the third link 28 with links of a watch band or watch strap (not shown).

The second link 20 and the third link 28 are of the same curvature as the first link 12. The third link 28 is of a width slightly smaller than the distance between the inner surfaces of the two legs 16 of the first link 12, so that the third link 28 may be received within the space between the two legs 16 of the first link 12.

Referring more particularly to FIG. 2, the first link 12 is provided with a surface 30 for supporting a lock plate 32, and allowing the lock plate 32 to slide relative to the first link 12 outwardly (i.e. in the direction indicated by the arrow H in FIG. 2) or inwardly (i.e. opposite to the direction indicated by the arrow H). Two springs 34 are provided behind two extensions 36 of the lock plate 32 for biasing the lock plate 32 outwardly. The outward sliding movement of the lock plate 32 is limited by two stoppers 38 of the first link 12.

The surface 30 of the first link 12 has an elongate hole 40 and the lock plate 32 also has an elongate hole 42, both for receiving a rib 44 of a button 46, the function of which will be discussed below. A cover block 48 is secured to the first link 12 by two screws 50 for containing the lock plate 32, the springs 34, and the button 46 in the first link 12. The cover block 48 has a through hole 54 sized and configured to allow relative sliding movement of a slanted body 56 of the button 46.

Figure 5:
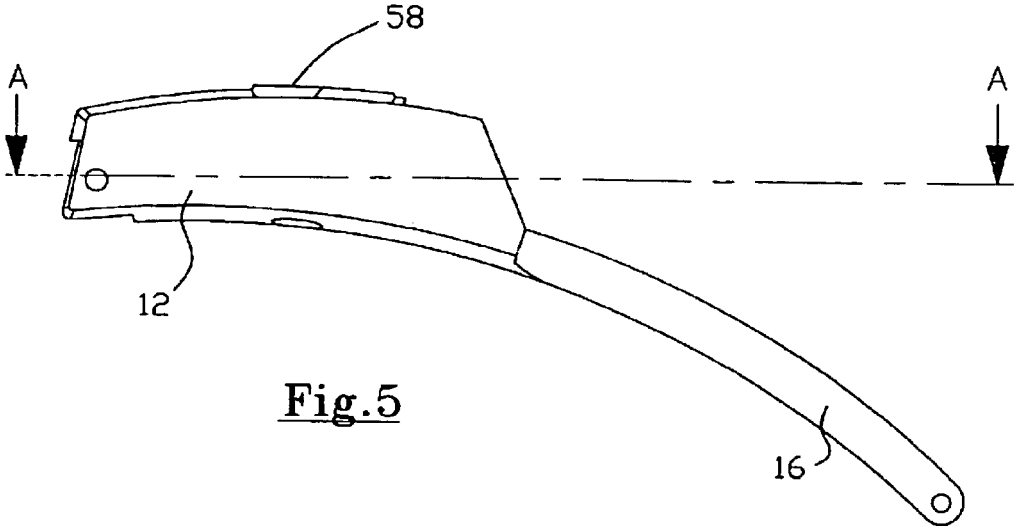
FIG. 5 is an enlarged side view of the buckle shown in FIG. 3.
Figure 6:
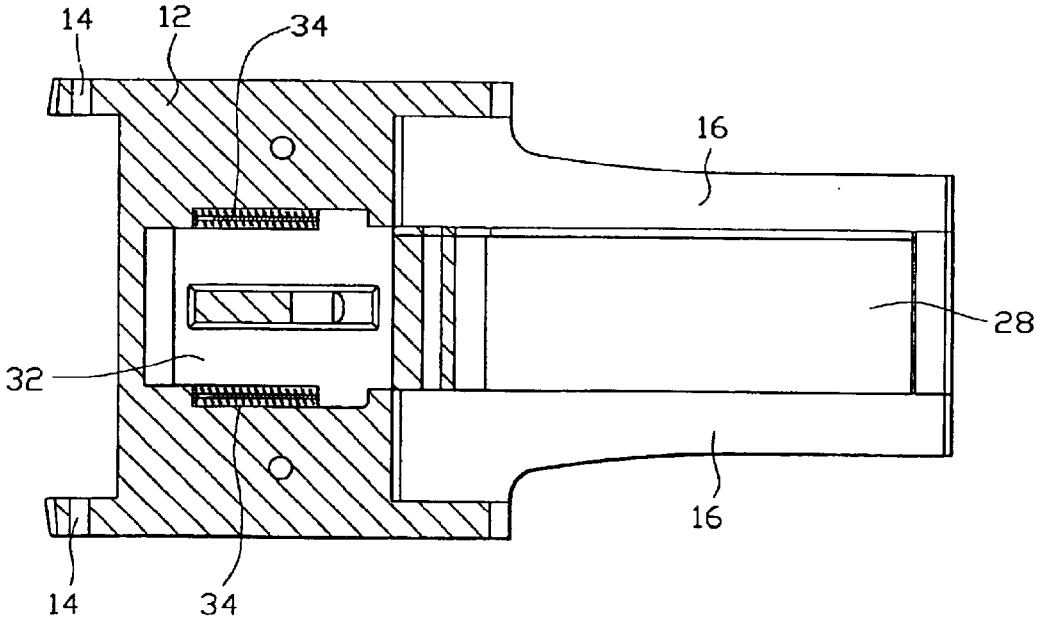
FIG. 6 is a sectional view of the buckle taken along the line A—A in FIG. 5.
Figure 7:
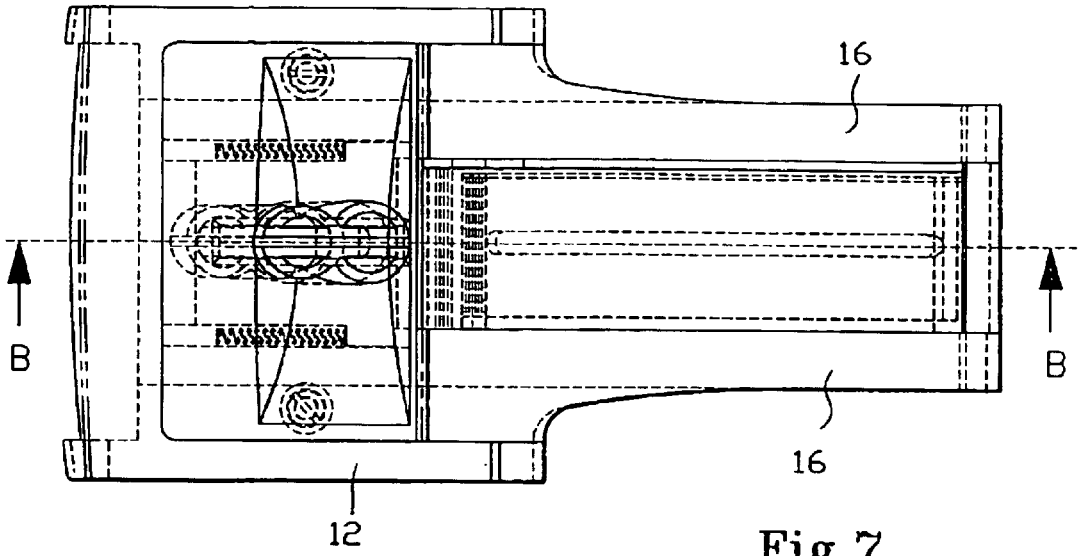
FIG. 7 is an enlarged top view of the buckle shown in FIG. 3.
Figure 8:
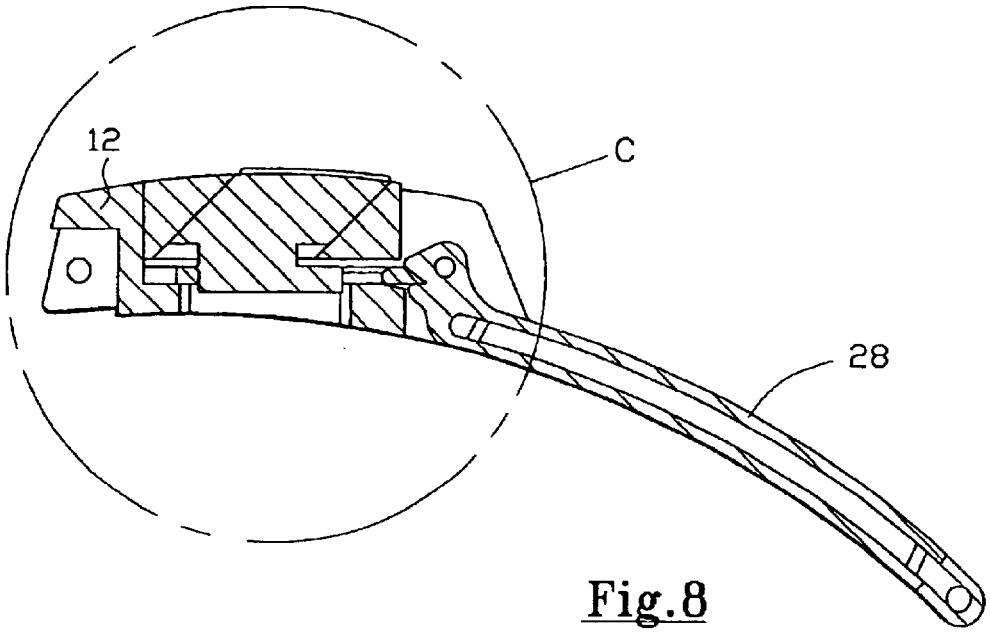
FIG. 8 is a sectional view of the buckle taken along the line B—B in FIG. 7.
Figure 9:
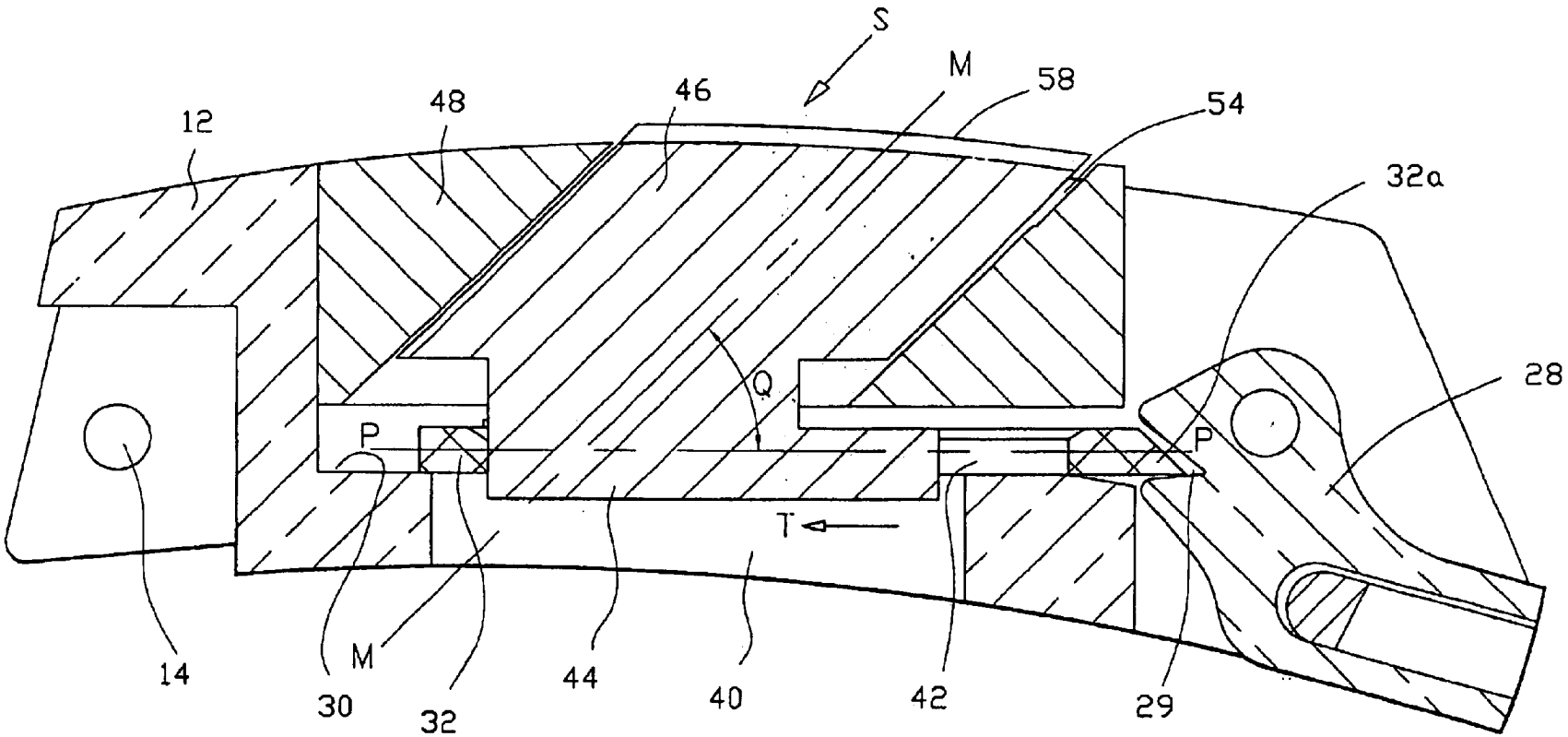
FIG. 9 is an enlarged view of the encircled part in FIG. 8.
Figure 10:
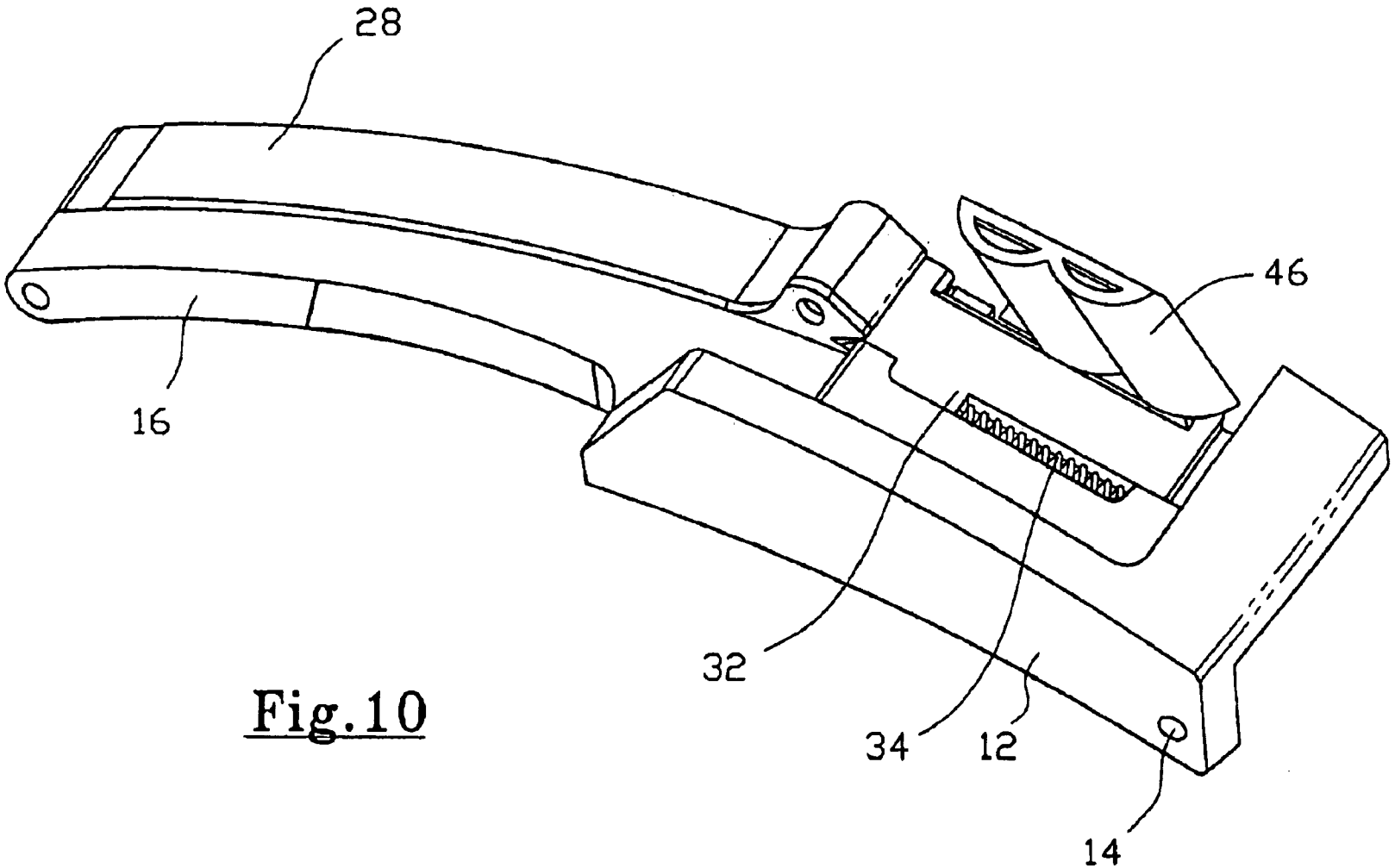
FIG. 10 is a left partial sectioned perspective view of the buckle shown in FIG. 3.
Figure 11:
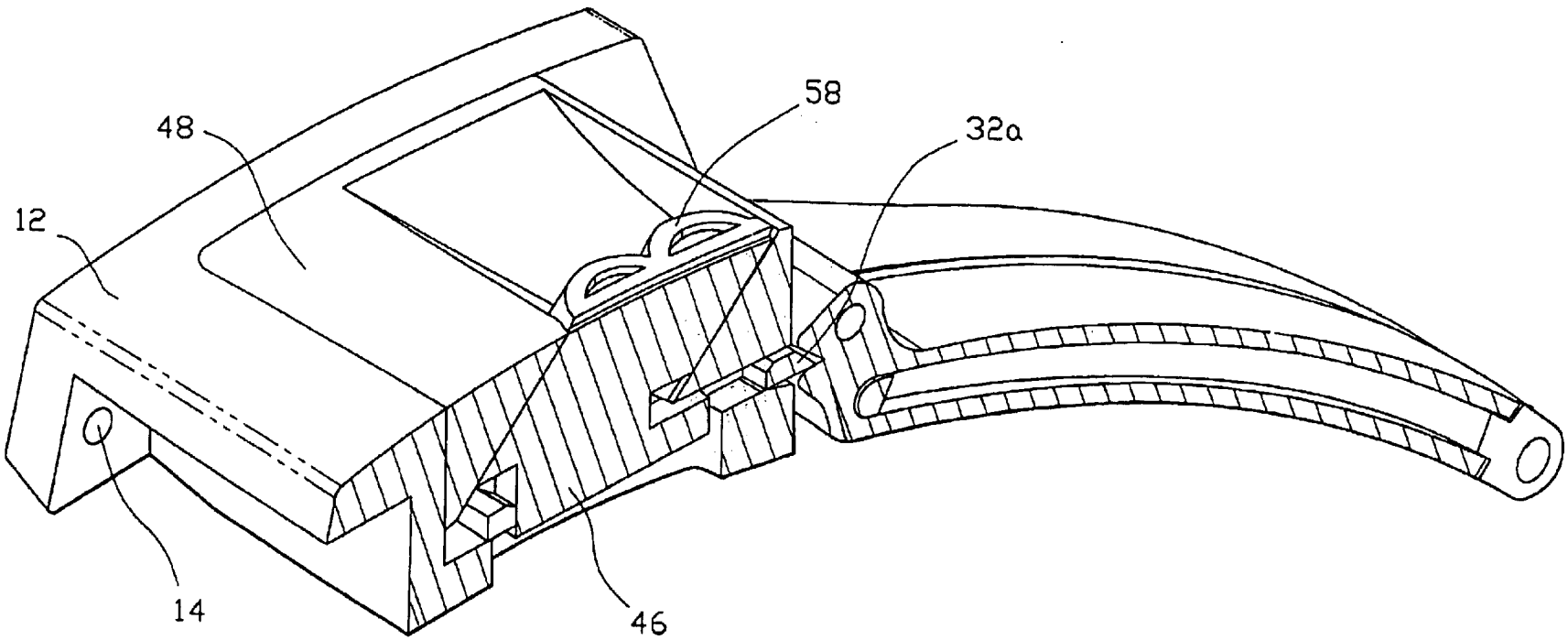
FIG. 11 is a right partial sectioned perspective view of the buckle shown in FIG. 3.
Figure 12:
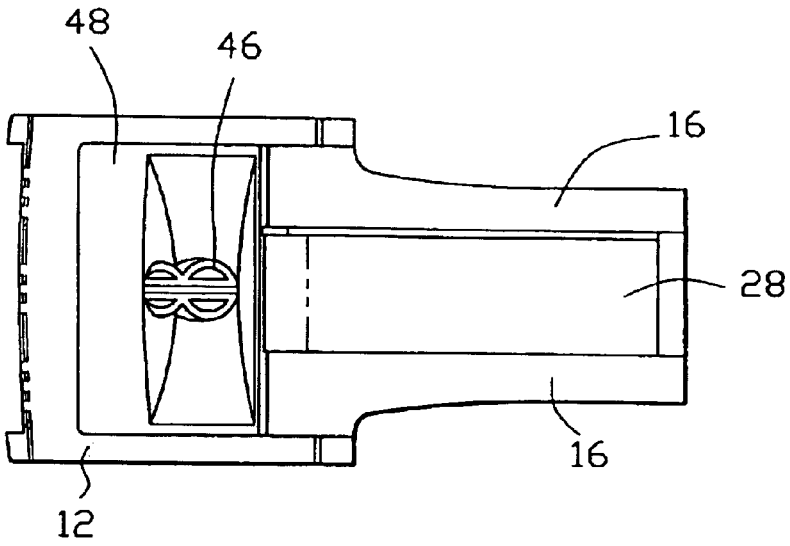
FIG. 12 is a top view of the buckle shown in FIG. 1 in an unlocked configuration.
Figure 13:
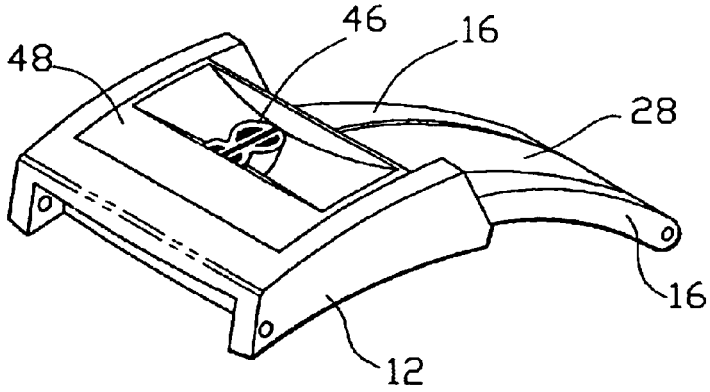
FIG. 13 is a perspective view of the buckle shown in FIG. 12.
Figure 14:
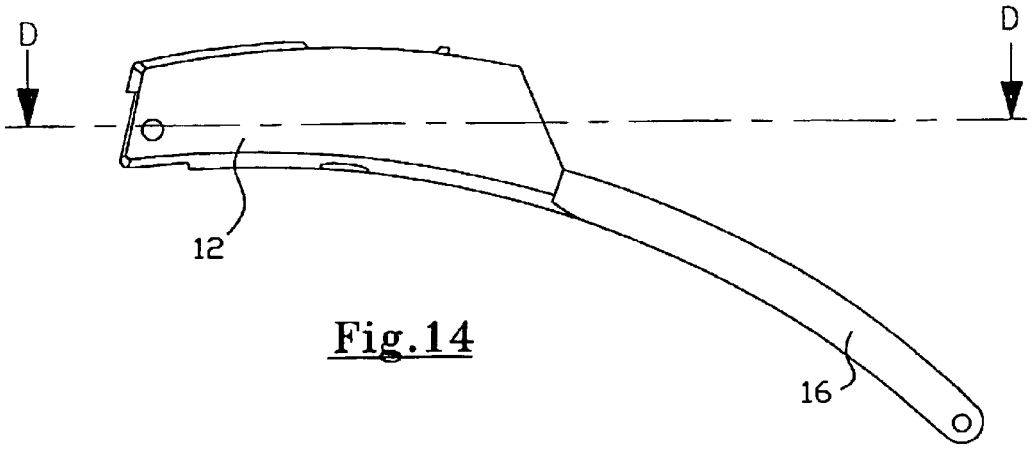
FIG. 14 is an enlarged side view of the buckle shown in FIG. 12.

FIGS. 3 to 11 show various views of the buckle 10 in the locked configuration, in which the first link 12 and the third link 28 are locked against relative movement. As can be seen in FIGS. 5 and 9, when the buckle 10 is in the locked configuration, a top surface 58 of the body 56 of the button 46 is slightly above the topmost surface of the first link 12. Referring to FIGS. 8 and 9, it can be seen that, when the buckle 10 is in the locked configuration, a front end 32*a* of the lock plate 32 extends beyond a cavity of the cover block 48, and is received within the recess 29 of the third link 28, such that the third link 28 and the second link 20 are prevented from moving relative to the first link 12. It can be seen that the rib 44 of the button 46 is received within the hole 40 below the surface 30 and the hole 42 of the lock plate 32. The button 46 can be moved relative to the cover block 48 along a path parallel to the line M—M shown in FIG. 9, which will cause the lock plate 32 to move along a path parallel to the line P—P, also shown in FIG. 9. The angle q between the line M—M and the line P—P is an acute angle, i.e. between 0° and 90°, preferably between 30° and 60°. In the preferred embodiment shown and discussed here, the angle q is 45°.

When the button 46 is pushed downwardly, i.e. in the direction indicated by the arrow S in FIG. 9, the rib 44 will move the lock plate 32 to move in the direction indicated by the arrow T, so as to disengage the front part 32*a* from the recess 29 of the third link 28, and unlock the third link 28 from the first link 12. In particular, the top surface 58 of the button 46 may be forced downwardly in the direction indicated by the arrow S. However, as the top surface 58 of the button 46 is, when the buckle 10 is in the locked configuration, only slightly above the surrounding surface of the first link 12, the button 46 will not be easily inadvertently operated to cause the front end 32*a* of the lock plate 32 to disengage from the recess 29 of the third link 28. The user has to consciously press on the button 46, e.g. by using his or her finger tip or finger nail, to effect disengagement between the first link 12 and the third link 28.

Figure 15:
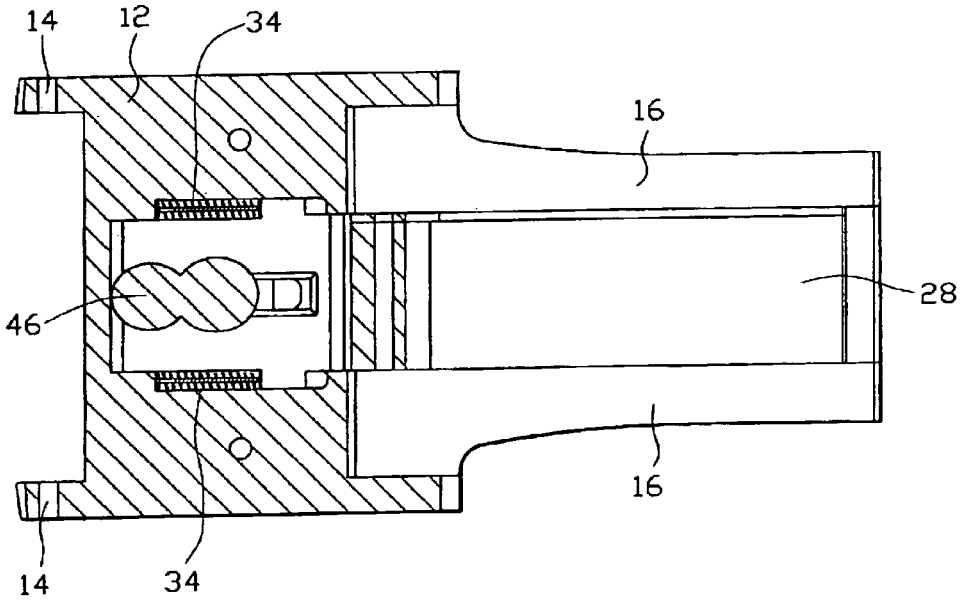
FIG. 15 is a sectional view of the buckle taken along the line D—D in FIG. 14.
Figure 16:
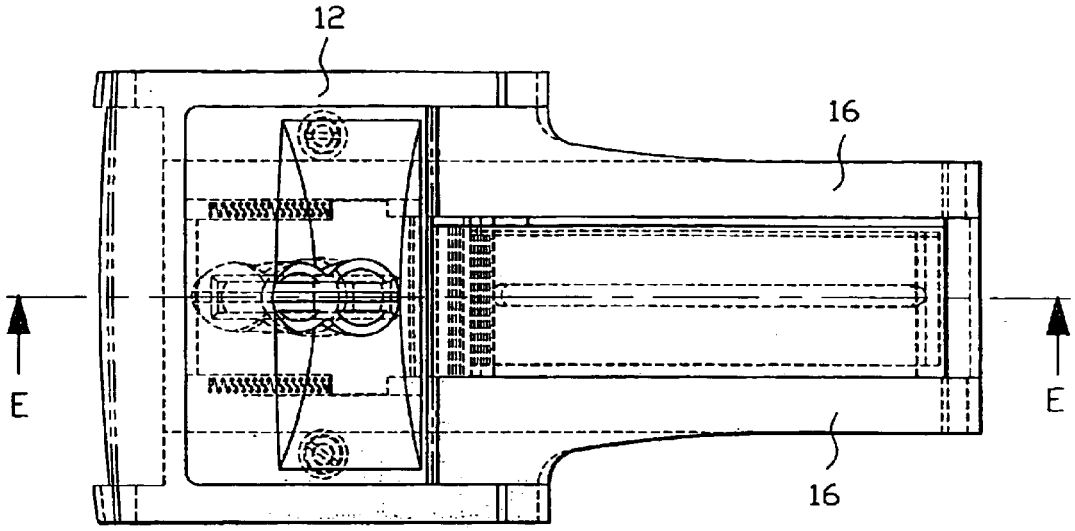
FIG. 16 is an enlarged top view of the buckle shown in FIG. 12.
Figure 17:
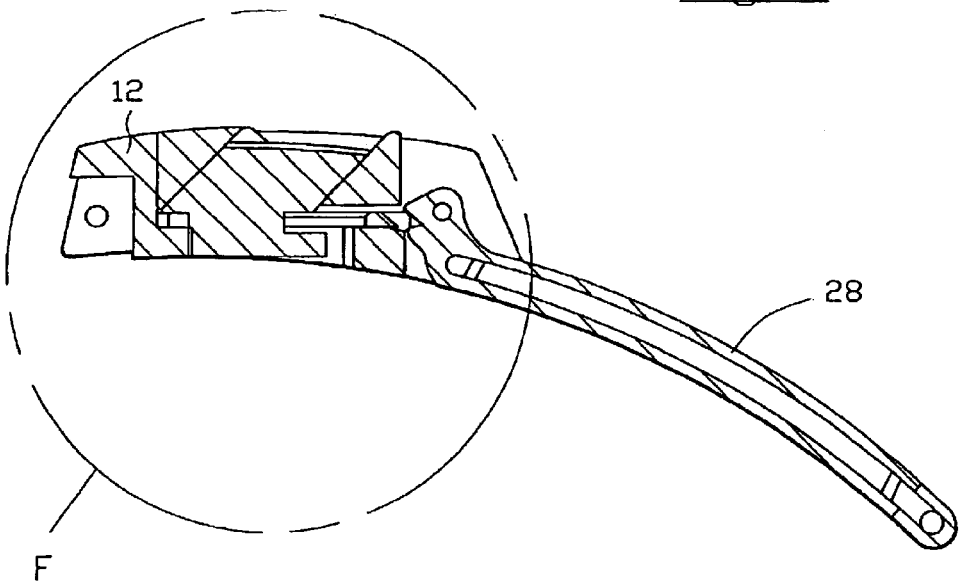
FIG. 17 is a sectional view of the buckle taken along the line E—E in FIG. 16.
Figure 18:
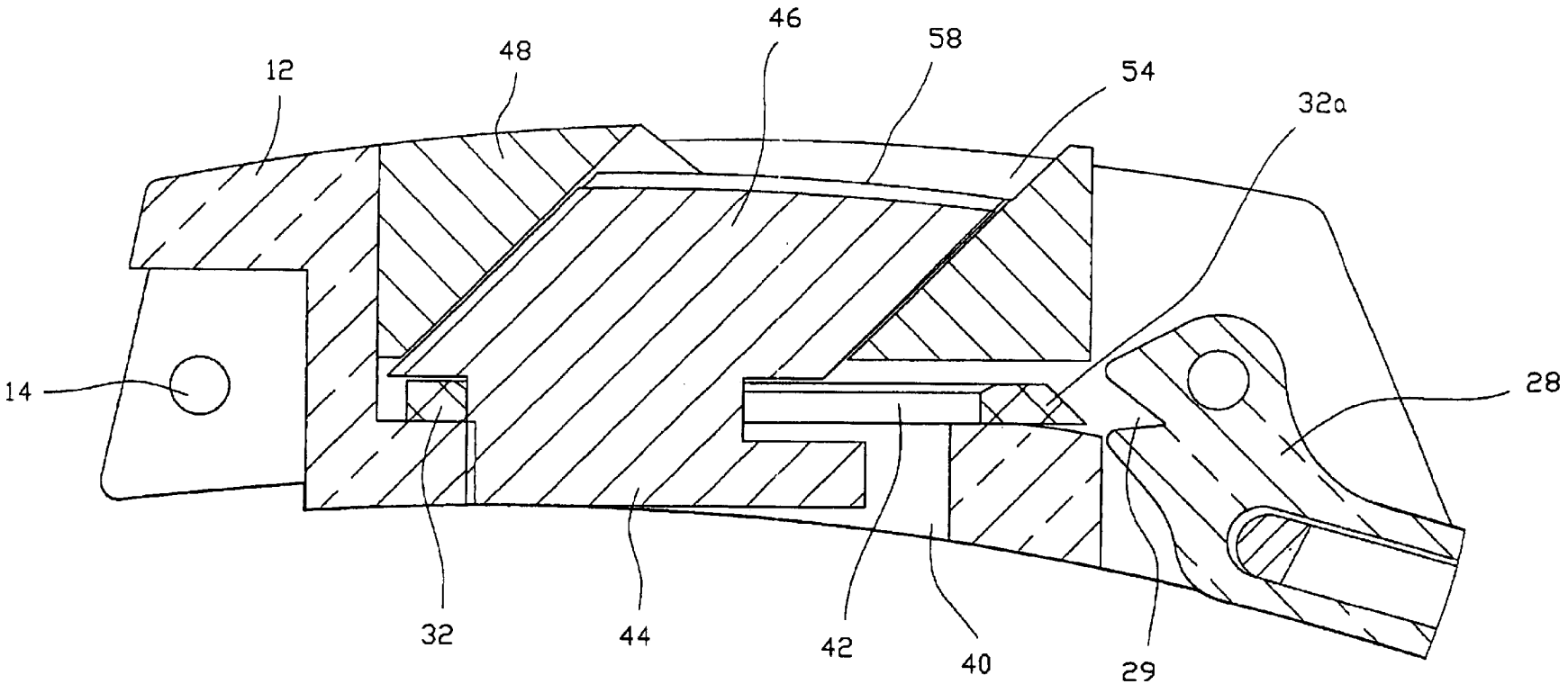
FIG. 18 is an enlarged view of the encircled part in FIG. 17.
Figure 19:
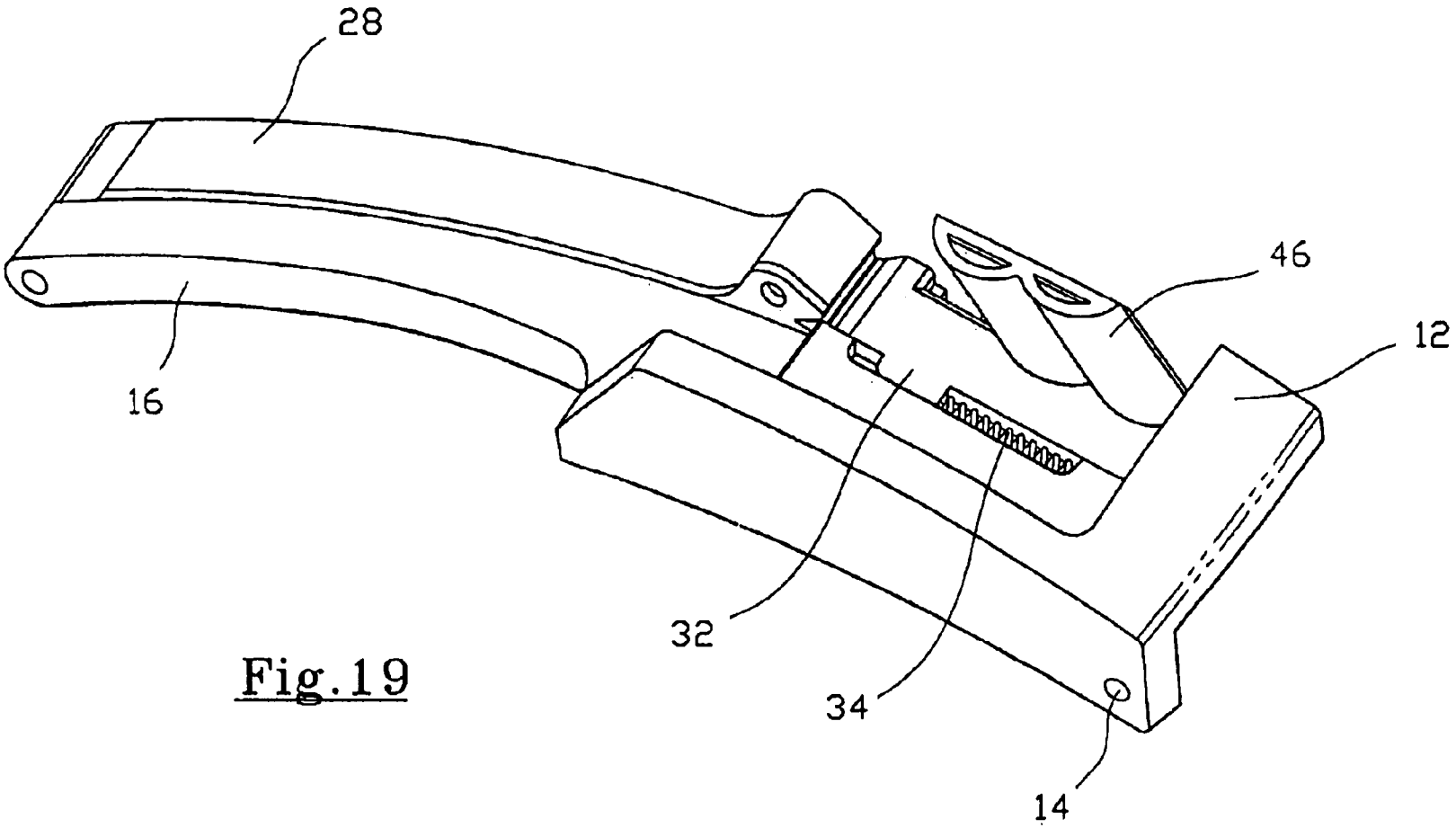
FIG. 19 is a left partial sectioned perspective view of the buckle shown in FIG. 12.
Figure 20:
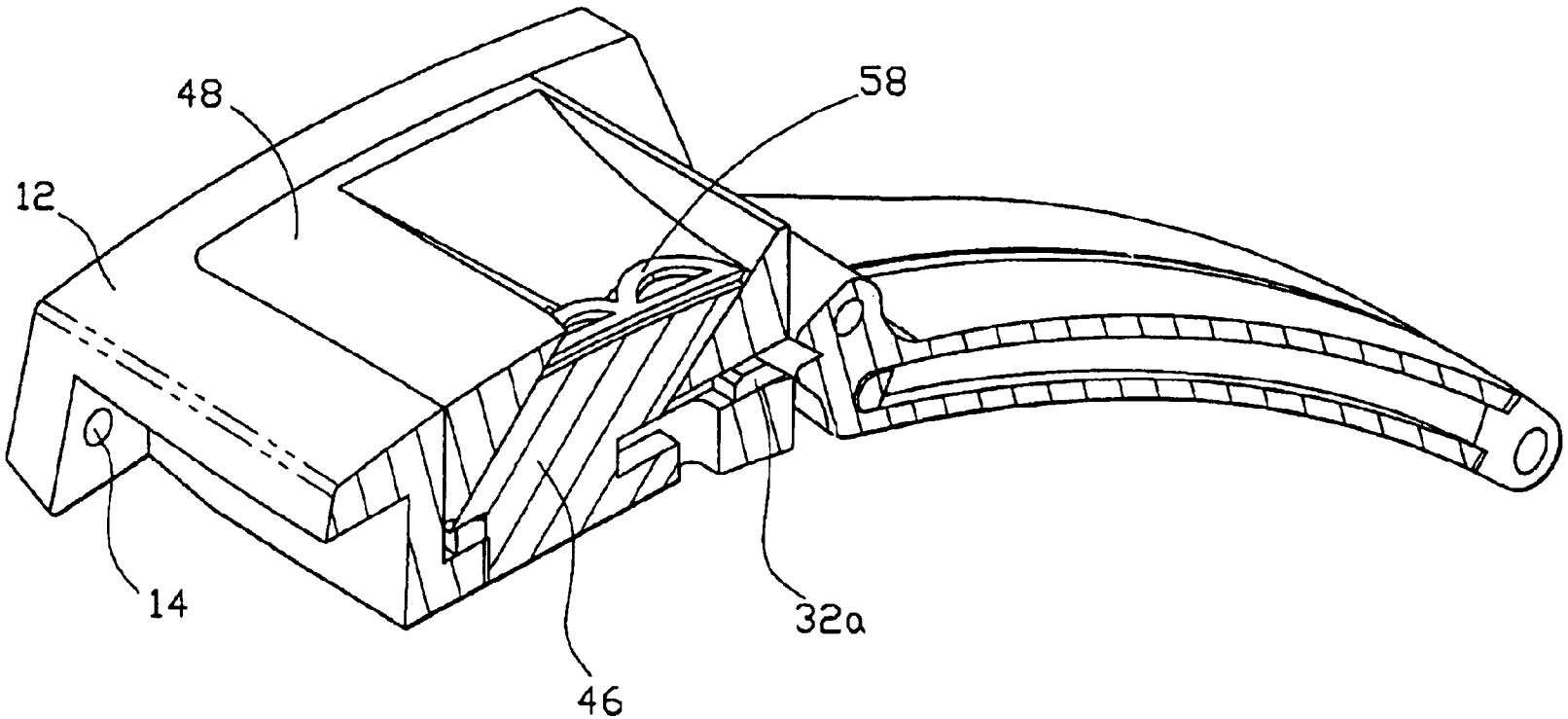
FIG. 20 is a right partial sectioned perspective view of the buckle shown in FIG. 12.

Turning to FIGS. 12 to 20, such show various views of the buckle 10 in the unlocked configuration, in which the first link 12 and the third link 28 may be moved relative to each other. As shown in FIG. 15, and compared with FIG. 6, it can be seen that when the button 46 is pressed down, the lock plate 32 is forced to move leftward (in sense of FIGS. 6 and 15) to compress the springs 34. As shown in FIGS. 17 and 18, when the button 46 is moved fully downwardly, and inwardly into the cover block 48, the lock plate 32 is moved leftward (in the sense of FIG. 18), so that the front end 32*a* of the lock plate 32 is disengaged from the recess 29 of the third link 28, and the lock plate 32 is fully received within a cavity of the cover block 48, and. The third link 28 may thus be unlocked from the first link 12 for relative movement. It can also be seen that when the button 46 is in this position, its top surface 58 is below the top surface of the cover block 48.

If the downward force applied on the button 46 is released, the lock plate 32 will, under the biasing force of the springs 34, move rightward (in the sense of FIG. 18) to resume its position as shown in FIG. 9, and the button 46 will also move upward and rightward (again in the sense of FIG. 18) to resume its position as shown in FIG. 9.

It should be understood that the above only illustrates an example whereby the present invention may be carried out, and that various modifications and/or alterations may be made thereto without departing from the spirit of the invention. For example, as is clear from the above discussion, the shape of the button 46 may vary, provided that it complements with the through-hole 54 for relative movement for operating the lock plate 32. The top surface 58 of the button 46 may thus be in the shape of an insignia or logo of the manufacturer.

It should also be understood that various features of the invention which are, for brevity, described here in the context of a single embodiment, may be provided separately or in any appropriate sub-combinations.

What is claimed is:

1. A buckle including a first body member and a second body member, wherein a first end of said first body member is engaged with a first end of said second body member for relative swiveling movement, and wherein said first body member includes a movable lock member operatively associated with an actuator of said first body member and releasably engageable with a recess of said second body member for locking said first body member and said second body member against relative movement, wherein said actuator is movable relative to said first body member along a first path to move said lock member along a second path between an extended position in which at least part of said lock member extends beyond a cavity of said first body member, and a retracted position in which said lock member is substantially wholly received within said cavity of said first body member, and wherein said first path intersects said second path at an acute angle.

2. A buckle according to claim 1 wherein said recess of said second body member is at or adjacent to a second end of said second body member.

3. A buckle according to claim 1 wherein said lock member is movable between an extended position in which at least part of said lock member extends beyond a cavity of said first body member, and a retracted position in which said lock member is substantially wholly received within said cavity of said first body member.

4. A buckle according to claim 3 wherein said lock member is adapted to lock said first body member and said second body member against relative movement when said lock member is in said extended position.

5. A buckle according to claim 3 wherein said lock member is biased towards said extended position.

6. A buckle according to claim 1 wherein said angle is between 30° and 60°.

7. A buckle according to claim 6 wherein said angle is substantially 45°.

8. A buckle according to claim 1 wherein when said lock member is in said extended position, at least a part of said actuator is above a topmost surface of said first body member.

9. A buckle according to claim 1 wherein when said lock member is in said retracted position, said actuator is below a topmost surface of said first body member.

10. A band secured with a buckle according to claim 1.

11. A band according to claim 10 wherein said band is a watch band.

* * * * *